US006256804B1

(12) United States Patent
Stevens

(10) Patent No.: US 6,256,804 B1
(45) Date of Patent: Jul. 10, 2001

(54) BODY SUPPORTS AND PROTECTORS

(76) Inventor: Emeline Stevens, P.O. Box 1219, Gracie Station, New York, NY (US) 10028

( * ) Notice: Subject to any disclaimer, the term of this patent is extended or adjusted under 35 U.S.C. 154(b) by 0 days.

(21) Appl. No.: 09/364,201

(22) Filed: Jul. 30, 1999

Related U.S. Application Data

(63) Continuation-in-part of application No. 08/897,182, filed on Jul. 21, 1997, now Pat. No. 5,951,366, which is a continuation-in-part of application No. 08/434,060, filed on May 3, 1995, now abandoned.

(51) Int. Cl.[7] ..... A61G 9/00

(52) U.S. Cl. ..... 4/456; 4/457; 4/245.1; 5/630; 5/632

(58) Field of Search ..... 2/267, 268, 455; 602/23; 5/630, 632, 633, 648, 650, 652, 652.1, 604; 604/317, 358, 365, 369, 373, 374; 128/112.1, 113.1, 117.1, 120.1, 123.1, 125.1, 845, 848; 4/245.1–245.9, 450, 452, 456

(56) References Cited

U.S. PATENT DOCUMENTS

| | | | | |
|---|---|---|---|---|
| 1,924,204 | * | 8/1933 | Young | 4/456 |
| 2,188,844 | * | 1/1940 | Pedersen | 4/456 |
| 2,242,088 | * | 5/1941 | Rainboth | 4/456 |
| 2,481,427 | * | 9/1949 | Hunter | 4/456 |
| 2,817,093 | * | 12/1957 | Rode | 4/456 |
| 3,100,303 | * | 8/1963 | Coulter | 4/456 |
| 3,939,502 | * | 2/1976 | Miller | 4/456 |
| 5,867,845 | * | 2/1999 | Fangmann | 4/456 |
| 5,960,494 | * | 10/1999 | Gilliland et al. | 4/456 |

* cited by examiner

*Primary Examiner*—Gloria M. Hale
(74) *Attorney, Agent, or Firm*—R. Neil Sudol; Henry D. Coleman; William J. Sapone

(57) ABSTRACT

A pillow-like protector and body support device having a central section stuffed with polyurethane and covered with soft hypoallergenic material is provided with cut-away air gaps and medial seams that form air grooves or channels. The pillows and supports are made for supporting various body parts, e.g., the neck, shoulder, torso, elbows, and tailbone. Many of the pillows/supports are capable of being used together into an integrated system for alleviating bedsores and other medical problems associated with sitting or lying in the same position for long periods of time. One embodiment of the invention relates to a coccyx protector and is adapted to slip over a bedpan. In addition, embodiments are disclosed related to breast supports. One version is a small pillow/protector with an airflow pocket. Another version is sling-like and includes an air circulation seam for the skin just beneath the pillow. Yet another version of the breast support for protecting both breasts. Several airflow scams are provided transversely across the pillow to provide ambient air access to the breasts. A cut-out enables ventilation of the torso near the base of the sternum. Straps are included to secure the same to the patient with minimum discomfort.

20 Claims, 12 Drawing Sheets

BODY SUPPORTS AND PROTECTORS

CROSS-REFERENCE TO RELATED APPLICATIONS

This is a continuation-in-part of U.S. application Ser. No. 08/897,182 filed Jul. 21, 1997 now U.S. Pat. No. 5,951,366 as a continuation-in-part of application Ser. No. 08/434,060 filed May 3, 1995, now abandoned. Application Ser. No. 08/897,182 has issued as U.S. Pat. No. 5,951,366.

BACKGROUND OF THE INVENTION

This invention relates to body support and protection devices; and, more particularly, to such devices used to support and protect areas and parts of the body of a person confined for prolonged periods to a bed, chair, wheelchair, or the like.

Prolonged confinement to a bed, chair, or wheelchair can result in discomfort to the person so confined. Quite often such confinement also results in complications including bed sores (decubiti) or other ulcerations. The discomfort, sores, and ulcerations are generated by the continued contact between particular areas and points of the body with the support surface, such as a mattress and its sheets, or other protective coverings. Lying in a particular position for a prolonged period produces prolonged external pressure on skin and body tissues covering rigid or bony body parts. This compromises the blood supply to these areas which, after a sustained period, results in local necrosis and the formation of sores constituting localized areas of dead tissue over bony body protuberances. Such conditions are aggravated when the patient is thin or has become thin due to prolonged periods of being an invalid and immobile. The discomfort, sores, and ulcerations are further exacerbated when the sheets and other bed coverings bunch up or wrinkle, which can occur with each movement of the person.

Quite often the regular turning of the person to a different position by attendants or hospital staff merely increases the number of body parts afflicted with the discomfort, sores, and ulcers.

Mattress-type body supports of configurations to provide support for particular body areas are known, as shown for example, in U.S. Pat. No. 1,548,728 granted on Aug. 4, 1925 to W. D. Milan for Mattress and U.S. Pat. No. 4,054,960 granted on Oct. 25, 1977 to John E. Petril, et al. for Inflatable Body Support Cushion Particularly To Support A Woman During Pregnancy. These body supports are constructed and configured only to accommodate a person lying in a face-down position, and with a peculiar body configuration (such as being pregnant), and as such are not suitable for use to prevent discomfort, sores, and ulcers for a person who must lie or sit for prolonged periods of time. Body part supports such as those shown and described in U.S. Pat. No. 1,170,119 granted Feb. 1, 1916 to F. W. Sefton for Chiropractic Adjusting Table, and in U.S. Pat. No. 4,596,384 granted on Jun. 24, 1986 to E. E. Blosser for Spinal Adjustment Table are also peculiarly adapted to support persons lying in a facedown position and as such are unsuitable for accommodating persons who are confined to lie or sit on their backs, sides, or other similar positions.

Still other specialized body supports are shown and described in, for example, U.S. Pat. No. 4,584,730 on Apr. 29, 1986 to E. Rajan for Device For Stabilizing The Pelvis Of A Patient Lying On His Side. This device, however, is only usable for pelvis stabilization and is not suitable or applicable to facilitate reduciton in bed sores and ulcerations for persons who are confined to beds or wheelchairs for prolonged periods but who are permitted to assume a number of positions while doing so.

Other mattress type body supports are shown, for example, in U.S. Pat. No. 3,428,974 granted on Feb. 25, 1969 to J. C. Stuart for Compartmented Air Mattress, in U.S. Pat. No. 4,290,155 granted on Sep. 22, 1981 to P. B. Hanson for Articulated Bed, in U.S. Pat. No. 3,626,526 granted on Dec. 14, 1971 to E. P. R. Viel for Mattresses and in U.S. Pat. No. 3,451,071 granted on Jun. 24, 1969 to J. G. Whiteley for Means For Removing Pressure From Pressure Sores. The Stuart type mattress (U.S. Pat. No. 3,428,974) however, is merely made up of a number of inflatable sections of identical configuration and which are individually inflated to different pressures if desired and does not accommodate different body parts so as to minimize or prevent sores and ulcers. The Hanson type mattress (U.S. Pat. No. 4,290,155) is constructed with cut-outs to accommodate a couple engaged in sexual intercourse in various positions and is completely unsuited for relieving pressure on body parts of persons confined to bed for prolonged periods. A mattress of the Viel type (U.S. Pat. No. 3,626,526) requires a highly complex construction which, when completed, is best suited to accommodate the body configuration of a single individual and is thus costly and lacks versatility. While a mattress of the Whiteley type (U.S. Pat. No. 3,451,071) is constructed for persons with trochanteric pressure sores on their hips, the reference neither teaches nor shows constructions suitable and adaptable to other body parts. In addition, the Whiteley construction requires tilizing a large number of abutting ancillary pads in conduction with the decubitus pad and thus increases the relative cost of the device while adding to the number of pads that must be stored and utilized.

Available and known constructions, such as those described above, moreover, are of mattresss or bed size and are peculiarly configured to support a person in the prone position.

Known pressure relieving pads are shown, for example, in U.S. Pat. No. 2,933,738 granted on Apr. 26, 1960 to K. J. Whelan for Pressure-Relieving Pad. Such a pad construciton requires the use of holes to accomodate particular body parts of the user and in doing so, may present juncture lines about such holes that may add to the discomfort of the user and may, in and of themselves, create sores and ulerations. In addition, possible close contact between other surfaces of such pads and the body parts of the user may prevent air circulation and add further to user discomfort and to possible sores and ulcerations.

Devices, such as that shown in U.S. Pat. No. 4,270,235 granted on Jun. 2, 1981 to G. L. Gutmann for Arm Support Pillow, on the other hand, are configured to support only an arm of a convalescing patient. That device does so with relatively stiff and unyielding material and in only one particular disposition. Alternatively, devices such as shown in U.S. Pat. No. 3,256,879 granted on Jun. 21, 1965 to H. E. Hipps for Invalid Heel Pad, in U.S. Pat. No. 2,478,497 granted on Aug. 9, 1949 to M. B. Morrison for Rest and in U.S. Pat. No. 4,278,079 granted on Jul. 14, 1981 to Orit Simboni, et al for Negative Heel Protector Cushion are intended to support heels and feet of patients but again do so with devices made of various kinds of foam rubber, leather, and Kappcock which cradle the limb under conditions which do not facilitate air circulation about the body part and disposition of the body part in other than a prone body position.

In U.S. Pat. No. 5,103,516 for Pillow-Like Body Supports and Protectors and System of Same, the present inventor disclosed a system of body support and protection devices for reducing these problems. That patent discloses a new and improved system for supporting and protecting body parts utlizing pillow-like supports and protectors. The system is designed for use in a sitting or a prone position. Supports and protectors are disclosed for the torso, the arms, the elbows, and the heels. These provide a soft cushion support while permitting the flow of air about the body part to minimize or eliminate bed sores and ulcers.

The invention of U.S. Pat. No. 5,103,516 discloses a system of pillow-like supports and body protectors for supporting body parts while either in a prone or sitting position. Supports and protectors are provided for the torso, arms, elbows, and heels of a person. The invention effectively provides a soft cushion support for these body parts while permitting the flow of air about the body part to thus minimize or eliminate bed sores and ulcers.

However, recovering patients may suffer from sores or ulcers on body parts other than the torso, arms, elbows, and heels. Additionally, patients recovering from certain types of surgery, e.g., breast surgery, can have very tender and sensitive areas of the body which require support and ventilation. Body parts that require support and ventilation incude the head and cervical region, spine, coccyx, head and shoulder area, elbows, buttocks, and breasts.

Moreover, it has been discovered that conventional support pads simply press against the skin or a patient and do not adequately allow ambient air to enter in between the pad and the skin. This lack of aeration can be uncomfortable and unhealthy.

SUMMARY OF THE INVENTION

Accordingly, it is an object of this invention to provide new and improved cushioned pillow-like body part support pads.

It is another object of this invention to provide new and improved pillow-like body part protectors.

It is yet another object of this invention to provide a new and improved system of pillow-like body part supports and protectors.

It is yet still another object of this invention to provide a new and improved system of pillow-like supports for supporting body parts while in either a prone or sitting position and to protect such body parts from sores and ulcers while so disposed.

It is a further object of this invention to provide a new and improved cushioned pillow-like support pad and protector for the head and cervical region of a person.

It is still a further object of this invention to provide a new and improved cushioned pillow-like support pad and protector for the spine of a person.

It is yet a further object of this invention to provide new and improved cushioned pillow-like support pads and protectors for the coccyx of a person.

It is yet still a further object of this invention to provide new and improved cushioned pillow-like support pads and protectors for the head and shoulders of a person.

It is yet still a further object of this invention to provide new and improved cushioned pillow-like support pads and protectors for the buttocks and genital area, and for use with bedpans.

It is yet still a further object of this invention to provide new and improved cushioned pillow-like support pads and protectors for the elbows of a person.

It is yet still a further object of this invention to provide new and improved cushioned pillow-like support pads and protectors for the breast or breasts of a person.

It is yet still a further object of this invention to provide new and improved cushioned pillow-like support pads and protectors for the head and cervical region, spine, coccyx, head and shoulders, elbows, buttocks and breasts of a person, that coordinate and act as a system to support and protect such body parts.

The above and other objects are achieved by the invention, which is a support pad that includes a main body section filled with soft fluffy material. The main body section has a front fabric panel and a rear fabric panel, where the rear fabric panel is adapted to be placeable against a person's body. The front and rear panels are attached to one another along at least a portion of their respective peripheries; the panels are either separate sheets of fabric that are sewn about their peripheries, or they can be a single sheet of fabric folded over itself and sewn around the edges. In either event, the soft fluffy material is disposed between the front and rear panels. The invention further includes and at least one medial seam formed in a central location of the main body section. The medial seam also attaches the front panel to the rear panel and thereby pinches the front and rear panels together in the central location to form a groove along the medial seam which allows ambient air to flow along the medial seam between the rear panel and the body.

In one embodiment, the invention includes a breast support pad for providing comfort to breasts. The pad includes a main body section filled with soft fluffy material, the main body section having a front fabric panel and a rear fabric panel; as above, the rear fabric panel is adapted to be placeable against a person's body beneath the breasts. The soft fluffy material is disposed between the front and rear panels. The front and rear panels are attached to one another along at least a portion of their respective peripheries. The breast pad of the invention possesses at least one medial seam formed in a central location of the main body section. The medial seam attaches the front panel to the rear panel and thereby pinches the front and rear panels together in the central location to form a groove along the medial seam which allows ambient air to flow along the medial seam between the rear panel and the body.

A particular pillow device in accordance with the present invention is used to cover a bedpan during use thereof. The pillow device provides support and protection during urinary relief. The pillow device includes a pillow member having a pair of opposed panels and resilient stuffing material disposed between the panels. The panels are provided with mutually aligned openings and are connected to one another along the openings to form a central opening or throughhole. A lip or arrest extends from one of the panels for holding a bedpan in position below the pillow member so that a cavity of the bedpan communicates with the central opening or throughhole. The lip may have an arcuate shape to conform to a side of a bedpan and thereby ensure a temporary locking of the bedpan to the pillow device.

In accordance with other features of this pillow device, a cut-through air slot extends from a periphery of the pillow member to the central opening or throughhole for allowing ambient air to circulate in from external to the pillow member and thus ventilate the body area resting upon the pillow member. Also, a medial seam is provided to form an air groove sewing the panels to one another in a substantially oval or circular path surrounding the central opening or throughhole. The pillow member may be formed with a raised oval shaped area thicker than other areas of the pillow member and substantially surrounding the central opening or throughhole, the oval shaped raised area fitting above the bedpan. A skirt is optionally attached to the pillow member about a periphery thereof.

In a lumbar support pillow in accordance with the present invention, a main body member is formed of a pair of panels connected to one another about respective peripheries. A pair of flaps are connected along seams to a side of the main body member, the flaps being formed with opposed concave edges defining therebetween an air gap for air circulation, the seams defining respective channels for air circulation. Where the panels of the main body member are made of air impermeable material, the main body member is provided with corners made of air permeable material. The flaps may be provided with releasable connector elements for forming a releasable connection to another pillow.

The present invention is a further extension of the teachings of U.S. Pat. No. 5,103,516, and discloses additional pillow-like supports and protector devices for supporting and protecting body parts. Devices are disclosed for providing head and cervical support, spinal support, support for the coccyx, head and shoulder protection, and breast support. In addition, a bed pan pillow and elbow rest are disclosed.

The unique system is specially designed to elevate, support, protect, ventilate, and relax pressure points on body parts to prevent and eliminate both first and second degree ulcers. It also serves to exercise a patient confined to a bed and a wheelchair. A major contributing factor to the product's effectiveness is its ability to provide ventilation and air flow to the supported body part, while maintaining good blood circulation in the area and providing both massage-like exercise and relaxation of the body and body parts.

The pillows can be used individually or in combinations as a system. They can be used by those in a bed, chair, or wheelchair. They are suitable for use in homes, hospitals, nursing homes, places of business, and hotels, among other areas. Similarly, they can be used in many different contexts and by those in numerous different professions, for example, drivers, shoemakers, tailors, dressmakers, or sportsmen.

In addition, the pillows can be covered with appropriate casings.

This invention involves the support and protection of parts of the human body, particularly when confined to a bed or wheelchair for prolonged periods of time to minimize if not eliminate bed sores and ulcerations that ensue from prolonged bed and wheelchair stays. It contemplates providing pillow-like supports and protectors for body parts (namely, the head and cervical region, spine, coccyx, head and shoulders, elbows, buttocks and breasts) which provide a soft cushion support for same while permitting the flow of air about the body part to thus minimize or eliminate bed sores and ulcers.

Other objects, features, and advantages of the invention in its details of construction and arrangement of parts will be seen from the above, from the following description of the preferred embodiments when considered with the drawing and from the appended claims.

DETAILED DESCRIPTION OF THE DRAWINGS AND OF THE PREFERRED EMBODIMENTS

Extended periods of immobility can result in discomfort, a consequence of the application of prolonged pressure on particular areas of the body. These pressurized areas or "pressure points" can become sore from the effects of the extended pressure. With time, sores, ulcers, hemorrhoids, and similar health-related problems can develop.

To alleviate these problems, the present application discloses a system of pillow-like supports and protectors which cushion, protect, ventilate, elevate, and massage areas of the body which are commonly affected by prolonged immobility. By reducing the pressure on the exterior of the body which results from prolonged periods of immobility, the supports also promote proper blood circulation.

The supports and protectors are constructed and configured to receive, cushion and ventilate those parts of a person's body which would otherwise come into direct contact with the bed or bed liner upon which they are lying. The supports and protectors are fabricated from a relatively soft material (such as Chem-Soft pillow ticking available from Chemstick Coated Fabrics, Inc. of Hicksville, N.Y.) stuffed with polyurethane. Restless patients who are not capable of adjusting pillows will not come into contact with sharp edges when utilizing these pillows since such have been carefully eliminated.

The inventive support pads allow for the ventilation of the supported parts of the body by providing air channels or grooves in median locations in the pad. The air channel or groove is formed by pinching the front and rear panels of the pad together in a non-peripheral location. inching the front and rear panels together can be accomplished by stitching, for example.

Figure 16A:
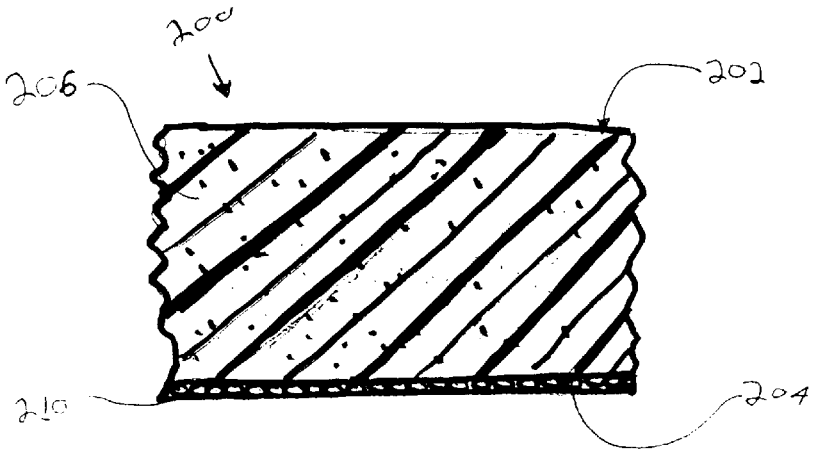
Fig. 16A PRIOR ART
FIG. 16A is a schematic cross-sectional view of a conventional support pad in contact with a person's skin.

A conventional support pad 200 is shown in FIG. 16A in section. It includes front panel 202 and rear panel 204. Puffy material 206 makes the support pad soft and yielding. Rear panel 204 is designed to be placed against the skin 210 of a person's body (not shown). Because there is no gap between rear panel 204 and the skin 210, air cannot contact the skin, and sweat can accumulate on the skin, leading to an uncomfortable and unhealthy condition.

Figure 16B:
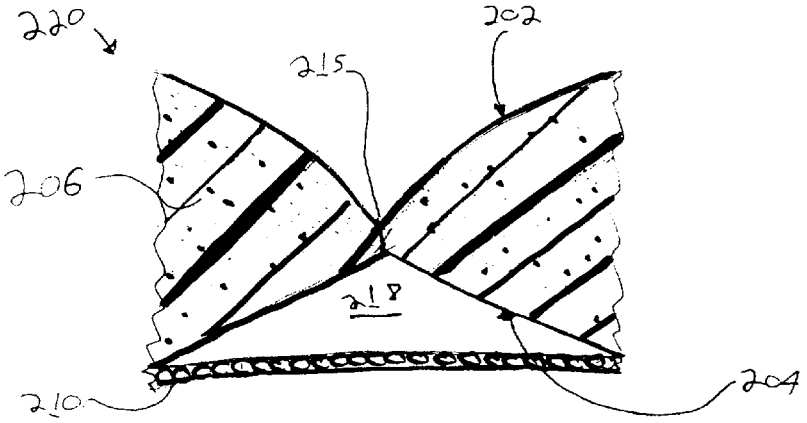
FIG. 16B is a schematic cross-sectional view of a support pad according to the present invention in contact with a person's skin.
Figure 16C:
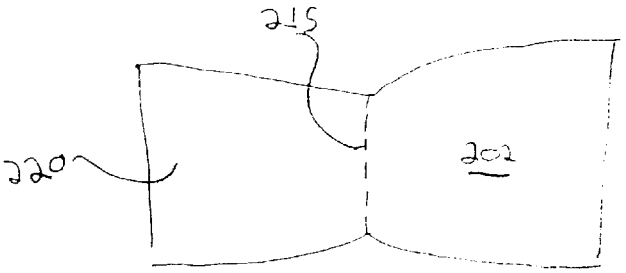
FIG. 16C is a schematic top plan view of a support pad according to the present invention.

The present invention alleviates this uncomfortable and unhealthy condition by allowing air to contact the skin. Instead of providing a conventional flat pad, the inventive pad includes an air groove designed to allow ambient air to contact the skin. As best shown in FIGS. 16B and 16C, pad 220 has front panel 202 and rear panel 204 as before. However, medial seam 215 is provided by, for example, stitching panels 202 and 204 together in a central location. The stitching of the front and rear panels 202 and 204 together in a central location pinches pad 220 away from skin 210 and forms air channel or groove 218. Pad 220 does not contact skin 210 at all points, owing to channel or groove 218, and as a result, ambient air is allowed to circulate and come into contact with the skin. Sweat can evaporate, and ulcers will be much less likely to form. It is preferable that medial seam 215 extend at least from one peripheral point on pad 220 to allow for better air circulation. The exemplary pad 220, as shown in FIG. 16C, employs a medial seam which extends from one peripheral point on pad 220 to a second peripheral point to allow for better air flow.

Description will now be given to specific pads contemplated as part of the invention. Some of these pads employ the above-described air channel or groove to enable ambient air to contact the supported body part, while some of the pads employ gaps or entire cut-out or cutaway portions for the same purpose, namely, to ventilate the supported body part.

Figure 1:
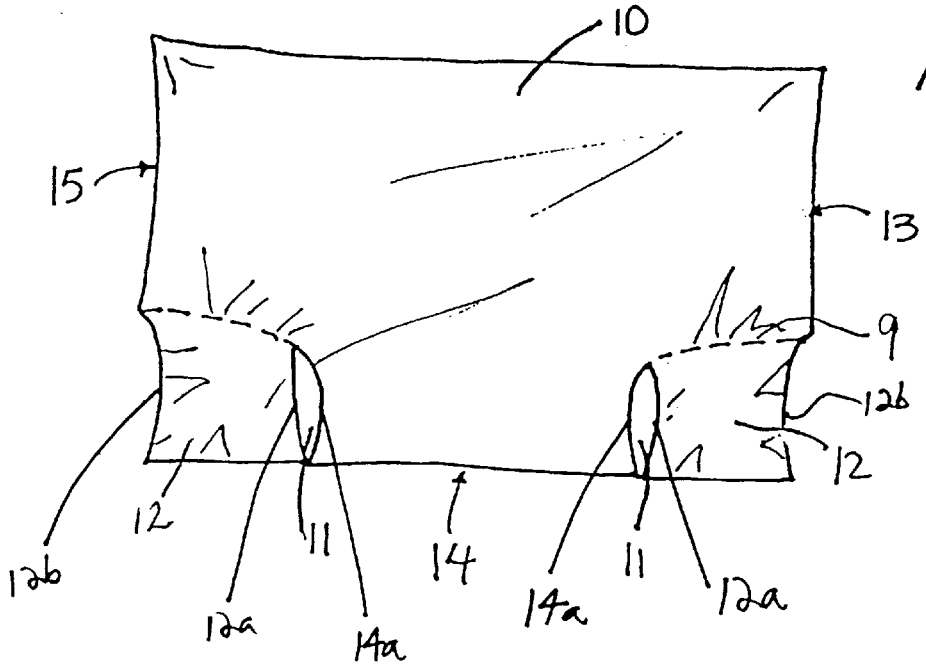
FIG. 1 is a plan view of a pillow-like support and protector for providing head and cervical support.

With reference to FIG. 1, a pillow-like head and cervical support and protector 10 is shown. The pillow provides head and cervical support when an individual rests his or her head and neck upon it. The pillow 10 has short side edges 13 and 15 which, along with top and bottom edges, are tapered or rounded to connect the top or front surface to the bottom or rear surface. Flaps 12 are defined along their respective inner sides by edge 12*a* and on their outer sides by edge 12*b*. Inner edge 12*a* is concave and curves inwardly towards the body of flap 12. A central flap 14 is disposed between flaps 12. The sides of flap 14 are defined by edges 14*a*, which are also concave and respectively curve away from edges 12*a* of flaps 12. Because both edges 12*a* and 14*a* are concave and curve away form each other, an air gap 11 is formed between each flap 12 and flap 14. Air gaps 11 allow ambient air to flow around the head and cervical region, providing ventilation. Also, the front panel of pillow 10 is sewn to the back panel of pillow 10 across the body of the pillow at seams 9. By pinching the front and rear panels of pillow 10 together (as in FIG. 16B, discussed above), air grooves or channels similar to air groove 218 are formed along seams 9 and ambient air is allowed to flow there along. Ambient air is allowed to contact the rear neck and shoulders and ventilate same. The pillow 10, flaps 12, and central flap 14 are all stuffed with a suitable material. A recommended stuffing is polyurethane.

Figure 2:
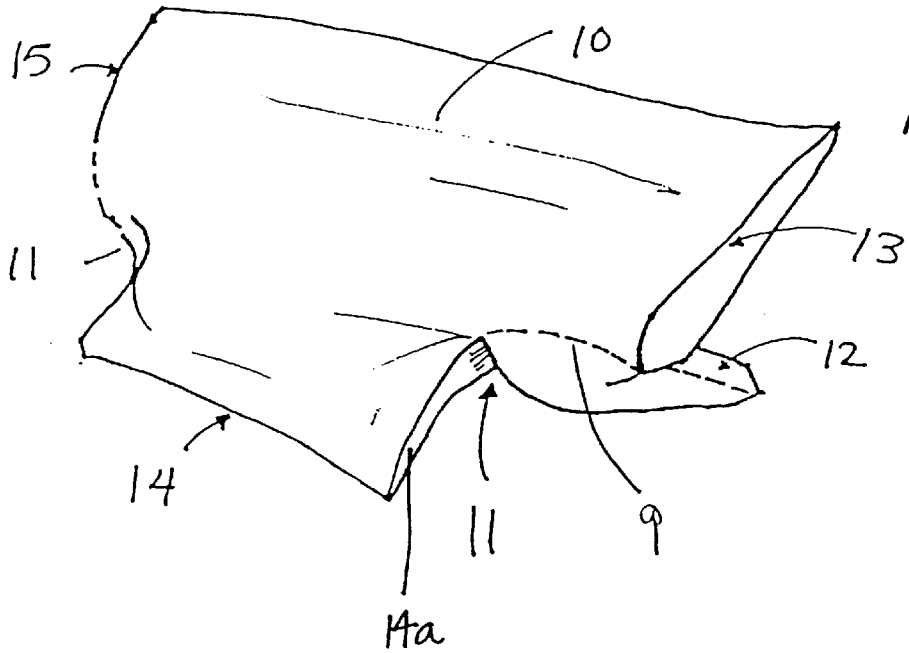
FIG. 2 is a perspective view of the device of FIG. 1, showing how the head and cervical support is positioned to interrelate with the device of FIG. 9.

Pillow 10 may be used with flaps 12 lying flat substantially in the same plane as pillow 10, or may be used with flaps 12 folded back along seams 9 as shown in FIG. 2. FIG. 2 displays use of the pillow shown in FIG. 1 with the flaps 12 in a folded back position and with center flap 14 extended forwardly. Seams 9 allow flaps 12 to conveniently fold backwardly, and by sewing the top and bottom surfaces of the pillow together, creates the above-mentioned air groove or channel along seams 9. It should be noted that ambient air can travel along the air groove above seam 9 when the flap is in either the flat or folded position. Folding flaps 12 back under pillow 10, raises the upper portion of the pillow and leaves central flap 14 forwardly extended to elevate and support the upper vertebral column, and to ventilate the head and cervical regions. With flaps 12 folded back, pillow 10 may be used in conjunction with a breast support of the type shown in FIG. 9. In such a configuration, as will be explained below, breast support 300A conveniently fits in the area beside central flap 14 and partially tucked under flap 12. Breast support 300A is placed in this area (where flaps 12 were located before they were folded backwardly) when a patient is lying on her side.

Figure 3:
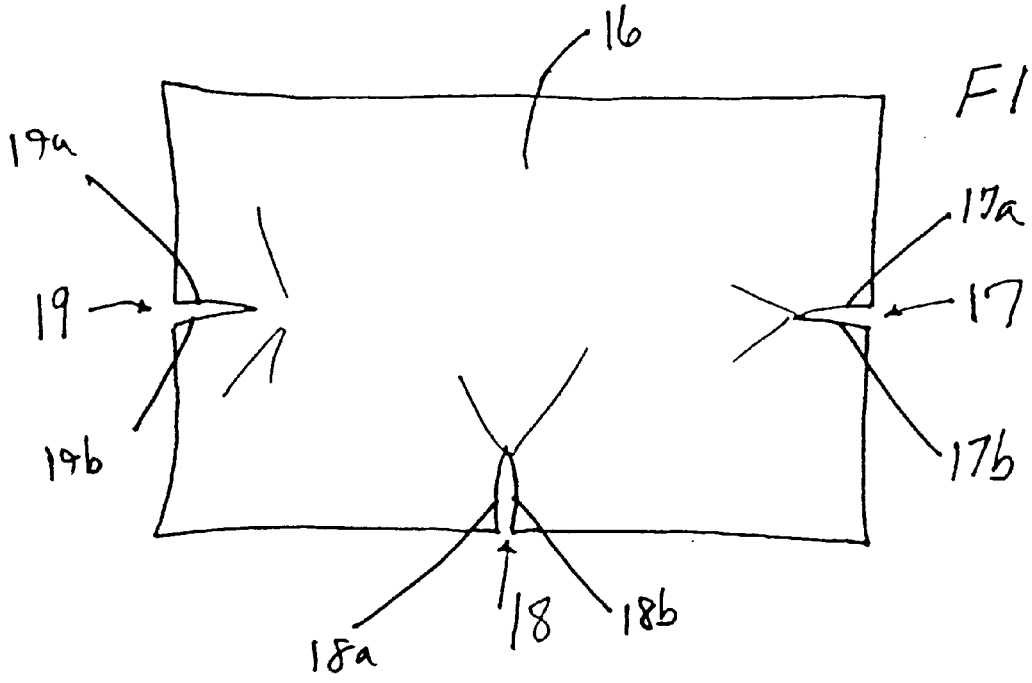
FIG. 3 is a plan view of a pillow-like support and protector for providing spinal support.

FIG. 3 shows a pillow-like support and protector 16 for providing spinal body support. The pillow provides support for the lower back area to just above the buttocks. Air gaps 17, 18, and 19, each having, respectively, side walls 17*a* and 17*b*, 18*a* and 18*b*, and 19*a* and 19*b*, are cut into the side edges of pillow 16. Air gaps 17–19 allow ambient air to come into contact with the body and thus to ventilate the body areas while the pillow provides elevation and support. The side walls 17*a*–19*b* of air gaps may be cut straight or concave.

Figure 4:
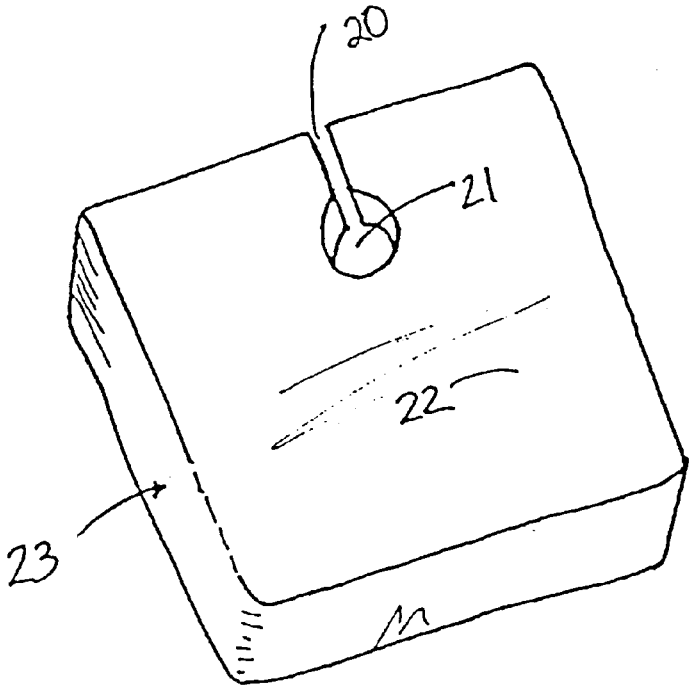
FIG. 4 is a perspective view of a pillow-like support and protector for the coccyx, the tailbone.

FIG. 4 shows what the inventor has coined as a Maxi-Cushion Support 22, i.e., a pillow-like support and protector. The cushion 22 provides support for the coccyx (also known as the tailbone). A patient sits or lies prone on the cushion 22 with the coccyx located above and over and slightly depressing into the keyhole shaped opening 21. Keyhole shaped opening 21 relieves pressure on the coccyx while cushion 22 cushions and provides support around it. Air slot 20 connects an edge of cushion 22 to opening 21 and allows ambient air to ventilate the coccyx area. The pillow 22 is sufficiently thick, i.e., elevated, as shown by vertical sides 23, so that the coccyx is supported and protected by the pillow and, in this way, the tailbone is protected from contact with a hard surface.

This support cushion is useful for anyone who sits prolonged periods. For example, the cushion can be used in an office environment, in a hospital, or while driving. The pillow removes and reduces pressure to the coccyx area, providing comfort while sitting. Thus, the pillow is also useful for those who have sensitivities or medical problems in this area, such as hemorrhoids, broken tailbones, or bony buttocks. A recommended material for fabricating the Maxi-Cushion Support is "Chem-Soft" material and foam. A recommended size is 15 inches by 18 inches. The vertical side walls 23 provide stability to the device and limit side to side rolling of the device beneath the patient's weight.

Figure 5:
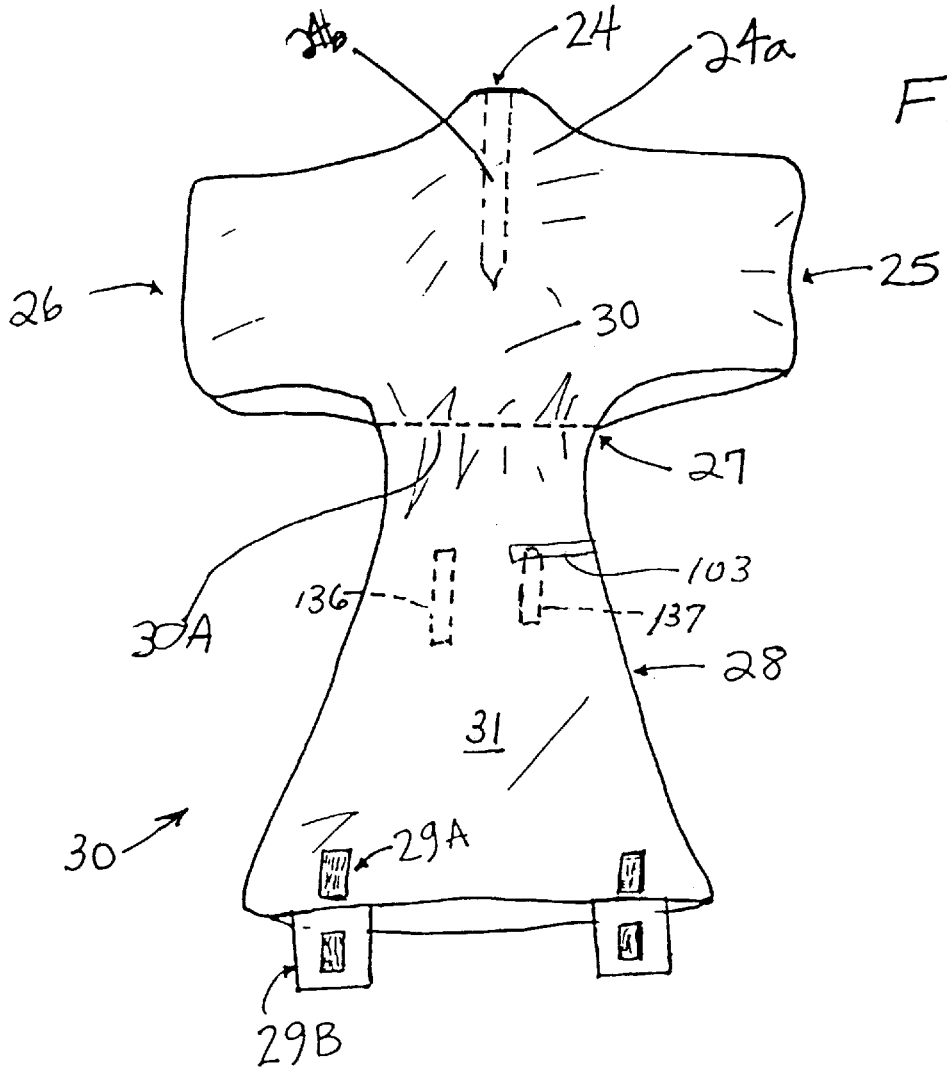
FIG. 5 is a plan view of a pillow-like support and protector for the head and shoulders.

FIG. 5 shows a head and shoulder pillow-like support and protector 30. The pillow 30 supports, protects, elevates and ventilates the head and shoulder regions of the body. The upper region of the pillow, defined by sides 25 and 26, elevate, support, and protect the scapula, upper back, and region around the head and neck. A center sewn air channel or pathway 24 helps ventilate this upper area. Air pathway 24 is formed by sewing the front panel of pillow 30 to the rear panel at seam 24*a*, in a fashion similar to that described in general for FIGS. 16B and 16C. The pillow has side curves 27 to guide air under and around the shoulder area for ventilation. A central median seam 30*a* is optionally disposed between curves 27 to allow ambient air to flow from one side of the pillow to the other, thereby better ventilating that part of the body which would otherwise be in contact with the pad. The pillow has a spinal cord area 31 defined by outwardly flaring sides 28, for supporting and resting the spinal column. Two vinyl strips 136 and 137 are sewn inside the pillow for reinforcement purposes.

In addition, the head and shoulder protector 30 can be used in conjunction with the spine guard of U.S. Pat. No. 5,103,516 (see FIG. 1 of that patent). Attachment means 29A, such as hooks of VELCRO™, or a flap with VELCRO 29B, can be used to attach the spinal guard to head and shoulder support 30. VELCRO segment 29A is used for securing the spinal guard when the patient lies down, while VELCRO segments 29B is used for securing the spinal guard of the '516 patent when the patient sits up.

The head and shoulder support 30 is made of an appropriate material and stuffing. Recommended materials are Chem Soft for the exterior, and polyurethane for the stuffing. Preferably, area 24*b*, the part of the pillow bounded by seam 24*a*, is unstuffed. The dimensions of the support 30 can be varied to adapt to different body sizes.

Figure 6:
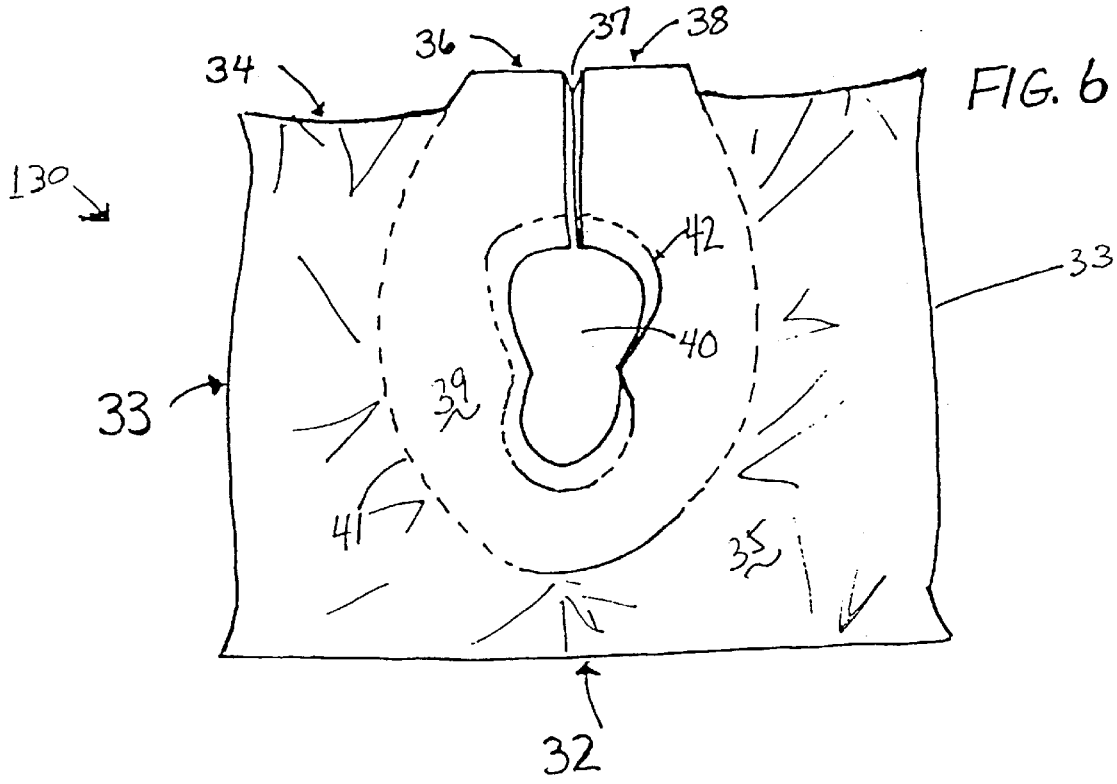
FIG. 6 is a plan view of a pillow-like support and protector for use with bedpans.
Figure 7:
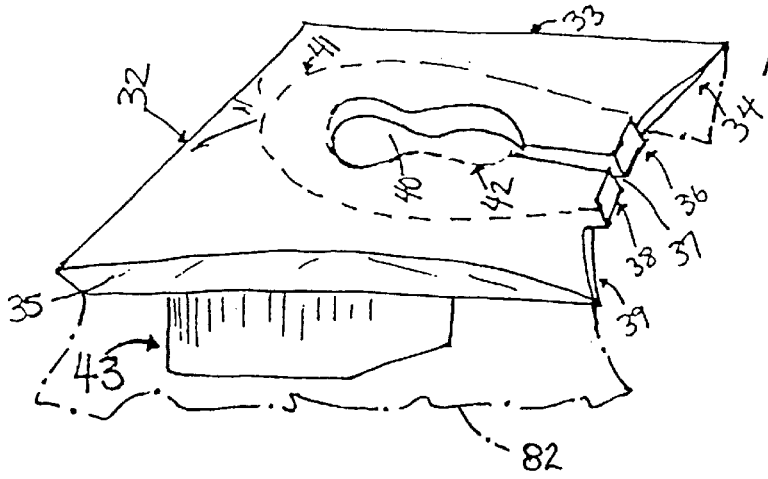
FIG. 7 is a perspective view of the device shown in FIG. 6.

FIGS. 6 and 7 show the protective urinary relief pillow-like support and protector 130. The support and protector 130 is adapted to fit on a bedpan. Pillow 35 has side edges 33, a lower edge 32, and an upper edge 34. A cut-through air slot 37 allows ambient air to circulate in from external to the protector 130 and thus ventilate the body area resting upon the pillow 35. This air slot extends form top edge 34 to an hourglass-shaped center opening or throughhole 40 of the pillow. Center opening or throughhole 40 is formed by connecting front and rear panels of pillow 35 to one another about a seam edge 42. A medial seam 41 is provided in a fashion similar to that shown in FIGS. 16B and 16C and forms an air groove similar to groove 218. Medial seam 41 is formed by sewing the top surface of the support to the bottom, in a substantially oval or circular path surrounding the opening 40 and terminating at top edge 34. In the center of the pillow is a raised oval shaped area 39, preferably made of foam or some similar type of material, with upper edges 36 and 38. The oval shaped raised area 39 fits above a bedpan, and is thicker than the other area of the pillow. Area 39 surrounds center opening 40. Waste matter from the patient may pass through opening 40 when the pillow 35 is place over a bedpan. A lip or arrest 43 (see FIG. 7) extends downwardly from pillow 35 and fits snugly by use of a VELCROT™-type connector or elastic (not shown), for example, about a bedpan and holds it in position under the pillow 35. A decorative or cosmetic skirt 82 is optionally attached to pillow 35 about a periphery thereof, for the purpose in part of hiding the bedpan from view during use thereof with pillow 35.

Protector 130 is made of an appropriate material, such as Chem Soft or another moisture repelling material. It is stuffed with shredded polyurethane to comfortably receive the hips and thighs, and soft foam at areas near the supported spine and buttocks. Recommended dimensions for the pillow are 35 to 27½ inches from edges 36 and 38 to lower edge 32 by 35 inches from side edge 33 to the other side. The recommended length for the air channel 37 is about 6½ inches. A recommended length for the opening 40 is about 16½ inches.

Protector 130 is especially designed for the support and protection of the incontinent bedridden patient. It complements the spine guard that is designed as a safeguard against bedsores and ulcers. It will keep the coccyx clean and dry, and is designed for use with or without a bedpan. Air flow and ventilation are provided by air slot 37 and the air groove above medial seam 41. These maintain dryness and air circulation. The genital area is kept clean, dry, and ventilated.

The protector is of great benefit to pre-operative and post-operative patients, and to those in the Intensive Care Unit. The comfort and support that the pillow supplies will allow a patient to lie on her back for a longer time while on a bedpan. It can be selectively attached to the Spine Support pillow by means of VELCRO or similar attachments, and is secured to the bedpan by the lip 43, so as to prevent slipping.

Figure 8:
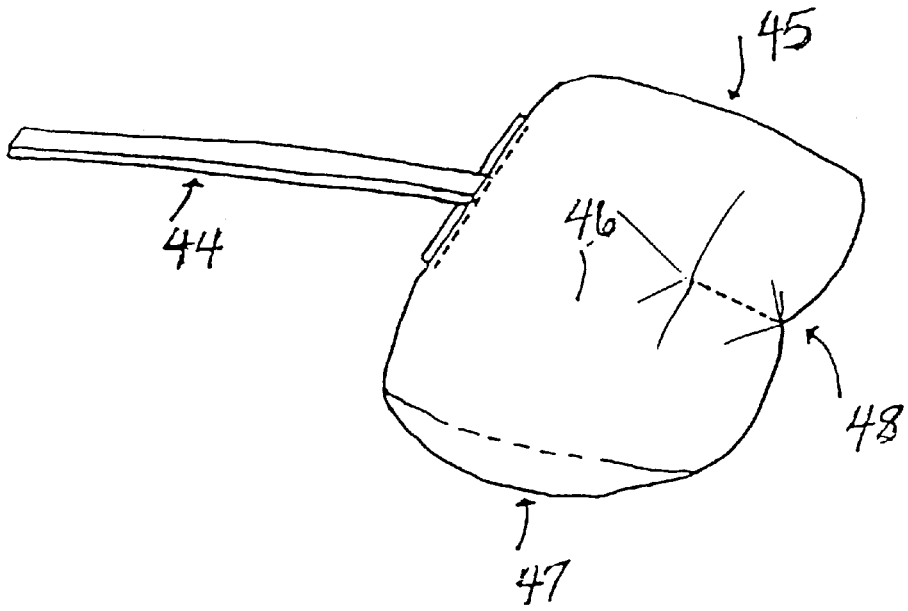
FIG. 8 is a perspective view of pillow-like support and protector for the elbow, which can be used with the device of FIG. 5.

FIG. 8 shows an elbow rest pillow-like support and protector 46. The pillow has sides 45 and 47 and a medial seam 48 midway between the sides to form an air flow groove. As with the other air grooves of the other pads (as shown schematically in FIGS. 16B and 16C), the groove is formed by sewing the top panel and the bottom panel of pillow 46 together, thereby pinching the pillow away from the skin and allowing ambient air to ventilate the skin. The device shown in FIG. 8 may preferably be used with the device of FIG. 5. The strap 44 is provided with one half of a VELCRO™ connector (e.g., hooks) while the head and shoulder protector 30 is provided with the other half of the VELCRO protector (e.g., loops) at connecting area 103 (see FIG. 5).

FIGS. 9–15 show three embodiments of a breast support and protector. The breast supports are specially designed to elevate, support, protect, ventilate, relax, and give comfort to the breast, after surgery.

Figure 9:
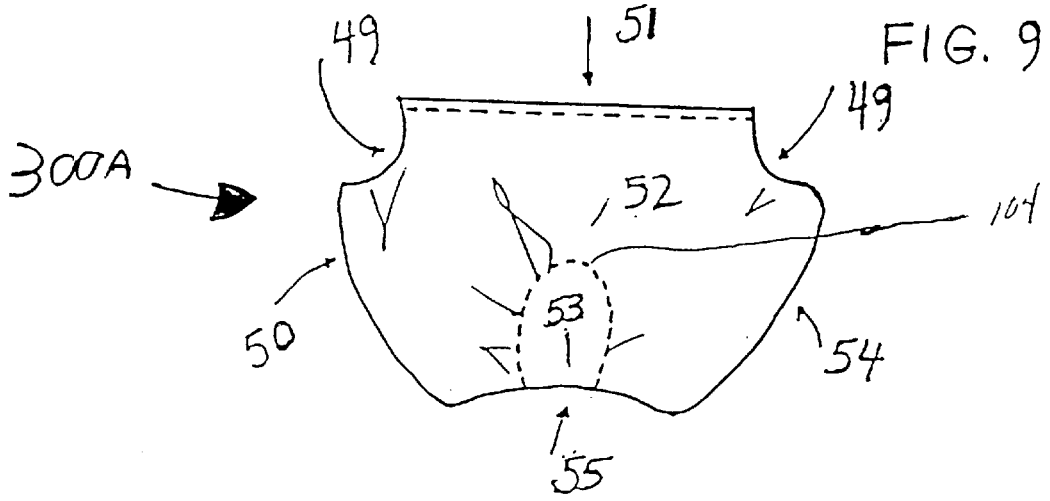
FIG. 9 is a side view of a first breast support and protector which can be used with the support of FIGS. 1 and 2.

FIG. 9 shows breast support and pillow-like protector 300A. This support 300A is intended for use when a patient is lying on her side. The breast support 300A includes pillow 52 having a top edge 51, and a bottom edge 55. Sides 50 and 54 are curved to eliminate pointed or sharp edges, and for flexibility. The pillow 52 has a sewn air pocket 53 formed by a seam 104 and cut-out areas 49 for air ventilation. Seam 104 fixes the front panel of pillow 52 to the rear panel in a fashion similar to that described in FIGS. 16B and 16C, and leaves air pocket 53 to allow ambient air to enter between the skin and pillow 52. Preferably, the area of pillow 52 bounded by seam 104 which forms pocket 53 is not filled with stuffing material for better ventilation. Breast support 300A fits into the area in FIG. 2 mentioned previously, vacated by flaps 12 when the flaps are folded under pillow 10. When positioned adjacent to the protector of figure 2, top edge 51 projects away from protector 10, while bottom edge 55 will be closely adjacent to the edge of center flap 14 and the backwardly turned flap 12. The pillow 52 (except for pocket 53) is stuffed with an appropriate material, such as polyurethane.

Figure 10:
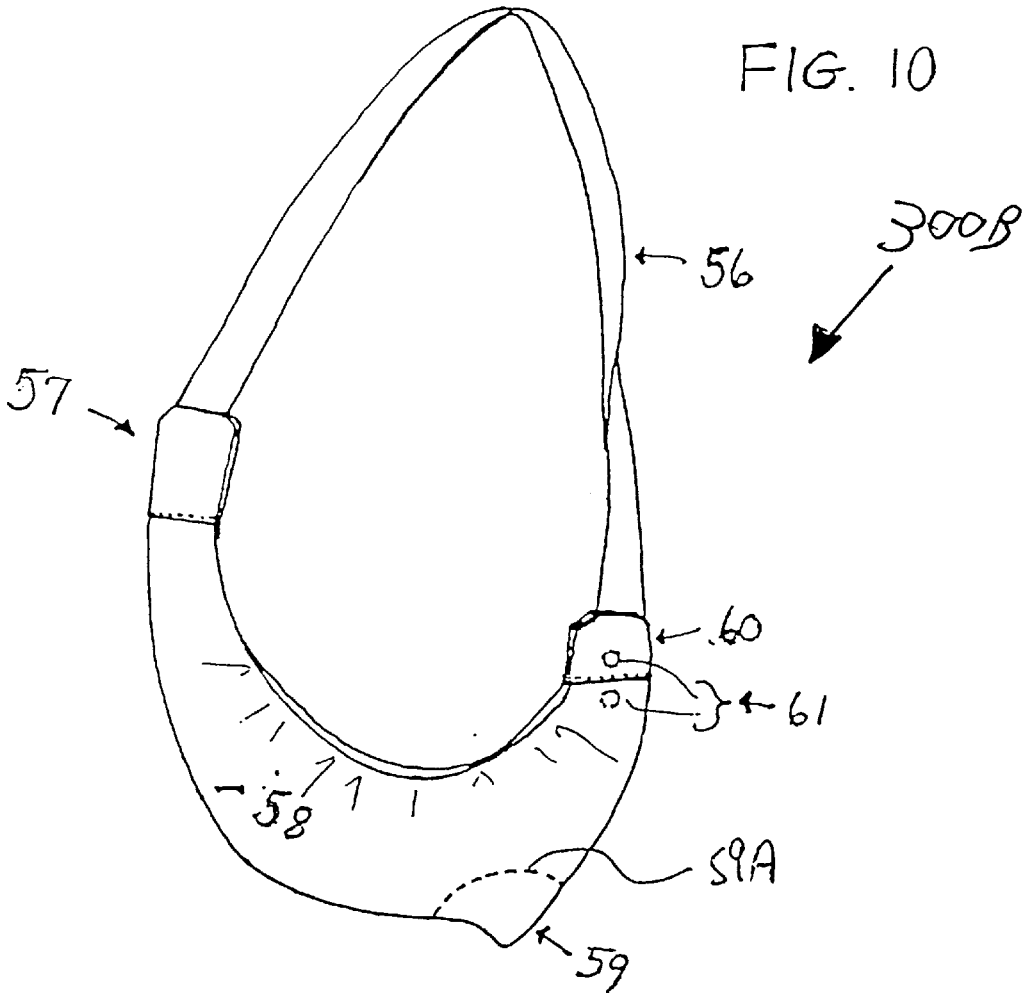
FIG. 10 is a perspective view of a second breast support and protector.
Figure 15:
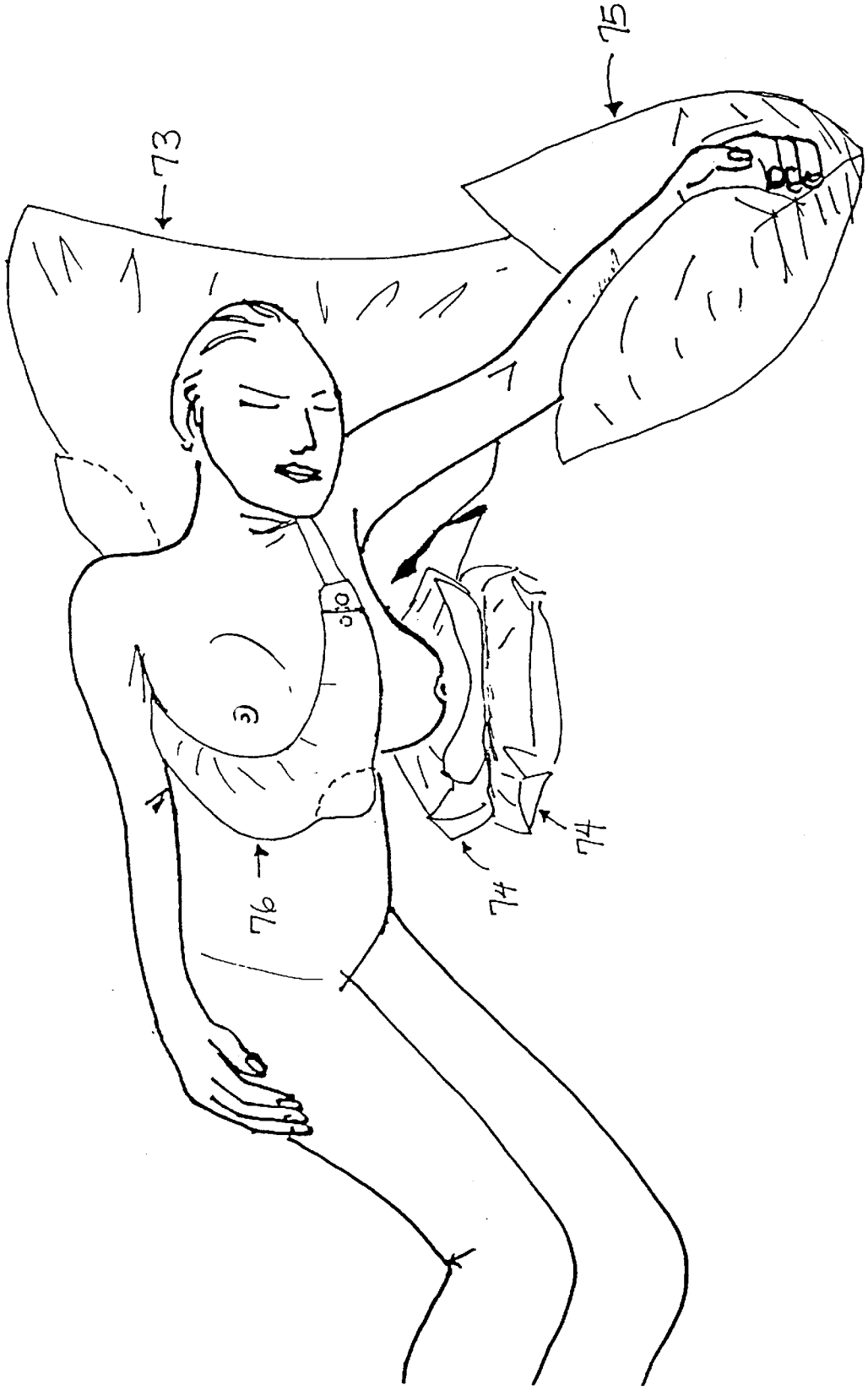
FIG. 15 is a perspective view of a person, lying on her side, while resting her head on the head and cervical support device (FIG. 1), resting the arm in a scapula elbow are rest, having one breast held in breast support of the type shown in FIG. 9 and resting the other breast on a pair of stacked breast supports of the type shown in FIG. 10.

FIG. 10 shows a breast support and pillow-like protector 300B having pillow 58. The protector 300B is for use while a patient is sitting or lying down, and is in the style of a sling for a single breast. It has a shoulder strap 56, sewn to the sling at flaps 57 and 60, and securing snaps 61 allowing some adjustability between the flap 60 and the rest of the sling. Pillow 58 fits underneath a single breast as shown in FIG. 15. At the bottom periphery of pillow 58 is flap 59 formed by seam 59*a*. Seam 59*a* attaches the front of pillow 58 to the rear of pillow 58, thereby forming an air groove along seam 59*a* in the same fashion as illustrated in FIGS. 16B and 16C. This air groove allows ambient air access to the skin under pillow 58 and ventilates it accordingly.

Alternatively, for large-breasted women, the breast may significantly hang over pillow 58, and seam 59*a* thus provides ventilation for the underside of the breast disposed over seam 59*a*. That is, scam 59*a* pinches the bottom panel of the pillow away from the torso (i.e., forms an air groove between the pillow and the torso) and allows air between the pillow and the torso, and simultaneously pinching the top panel of pillow 58 away from the breast overlying it (i.e., forms an air groove between the pillow and the underside of the breast) and thus provides ventilation for the underside of the breast (a larger breast would overlie pillow 58 and obstruct pillow 58 from view in, for example, FIG. 15). The pillow is stuffed with an appropriate material such as polyurethane. Breast support 300B is provided with a strap 56, secured on one end at flap 57 and secured on the other end by snaps at flap 60. When a patient lies on her side, one breast may rest upon breast support 300A, (shown in FIG. 9) while the second breast may be supported in the sling of breast support 300B (i.e., pillow 58), as shown in FIG. 15.

Figure 11:
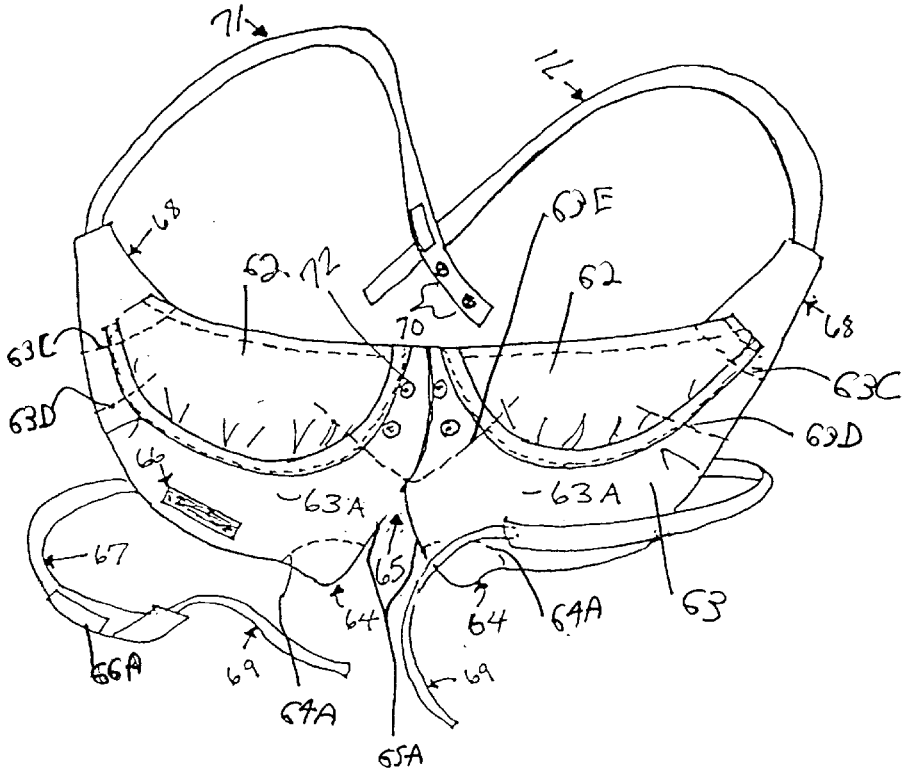
FIG. 11 is a front view of a dual breast support and protector.
Figure 12:
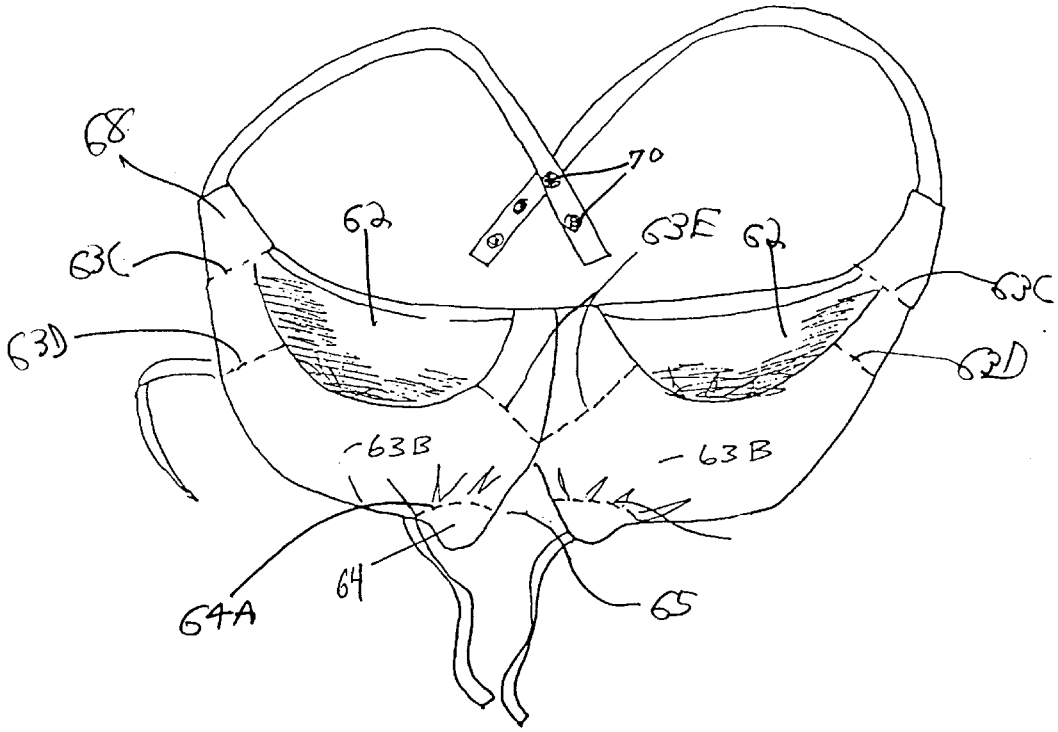
FIG. 12 is a rear view of the dual breast support and protector shown in FIG. 11.

FIGS. 11 and 12 shows a third breast support and protector 300C. Breast support 300C is designed to support both breasts at once when a patient is sitting or standing. Support 300C includes pillow 63 having front surface 63A and rear surface 63B. Pillow 63 is substantially W-shaped, and both breasts rest on top of (or, in the case of large breasts, also overlie) pillow 63 in a similar fashion as a single breast would using breast support 58 shown in FIG. 10. Preferably, breast cups 62 are provided attached to the upper edge of pillow 63. Cups 62 retain or at least partially retain the breasts, and protect the breasts from abrasion. For large-breasted women, part of the breasts may be retained behind cups 62 while part may overlie pillow 63.

Figure 13:
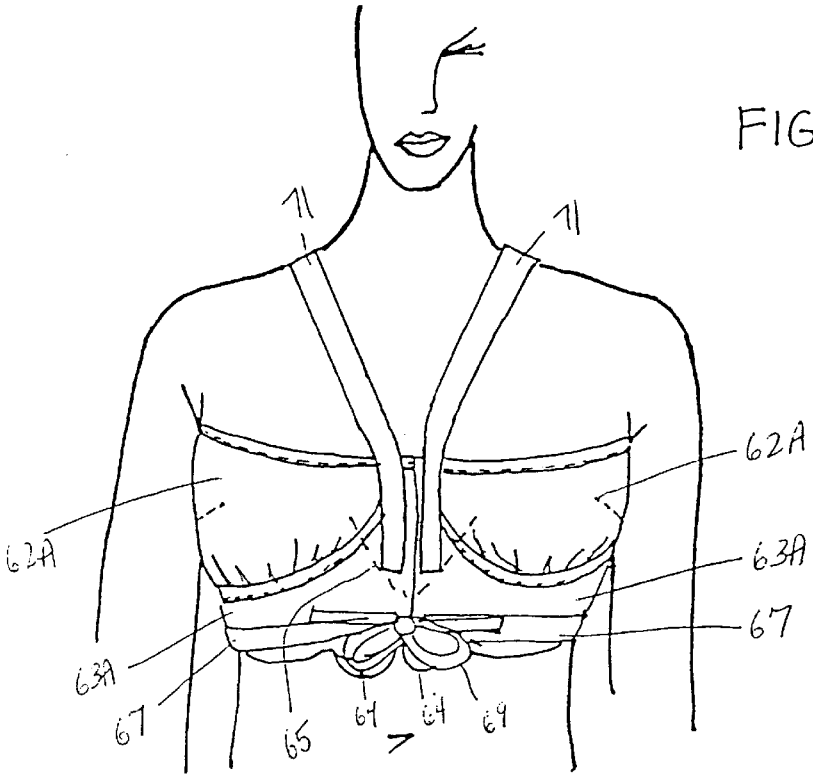
FIG. 13 is a front view of a person wearing the device of FIGS. 11–12.
Figure 14:
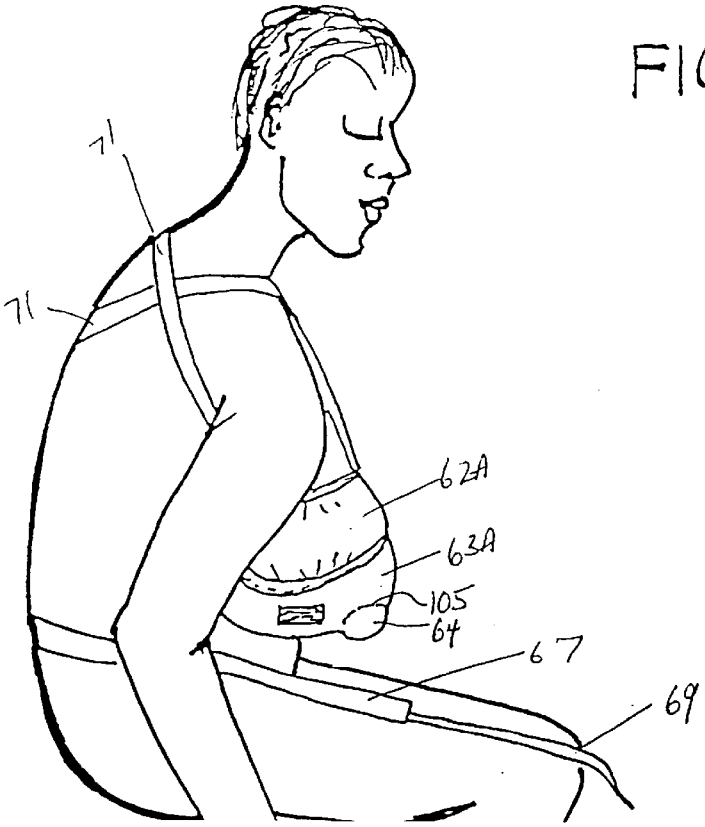
FIG. 14 is a side view of a person donning and wearing the device of FIGS. 11–12.

Formed integral with pillow 63 on opposite distal ends of pillow 63 are flaps 68 to which shoulder straps 71 are connected. Shoulder straps 71 go behind, cross over each other and over the neck, as shown in FIG. 14, to secure support 300C to a patient's body. The shoulder straps 71 are preferably provided with snaps 70 which secure to snap retainers 72 in the front central area of pillow 63 between cups 62. An illustration of the protector and support with the snaps engaged is shown in FIG. 13.

W-shaped pillow 63 is provided with several medial seams 63C, 63D, and 63E which are similar in structure and function to that which is shown in FIGS. 16B and 16C. That is, seams 63C–E secure front surface 63A to rear surface 63B and pinch the pillow surfaces together, thereby forming air grooves. Seams 63C–E each extend form one peripheral point on pillow 63 transversely across pillow 63 and terminate at another peripheral point adjacent to cups 62. These seams form air grooves which allow ambient air external to the pillow access to cups 62 (i.e., ambient air can flow along the grooves formed by the seams) to ventilate cups 62 and the breasts contained therein. Seams 63C and 63D are provided on the sides of pillow 63 while seams 63E are centrally disposed and may meet at a central point at or near cut-out 65 (to be described below).

In the center of W-shaped pillow 63 is an inverted V-shaped air cut-out 65 defined by edges 65A. Cut-out 65 allows ambient air to ventilate the breasts and the area of the torso below and between the breasts, i.e., near the base of the sternum. At the lower edge of pillow 63 of support 300C are provided two flaps 64, formed by seams 64A. Flaps 64 and seams 64A are similar in structure and function to flap 59 and seam 59A of the breast support 58 of FIG. 10. Seams 64A attaches the front surface 63A of pillow 63 to the rear surface 63B of pillow 63, thereby forming an air groove along seam 64A in the same fashion as illustrated in FIGS. 16B and 16C and similar to seams 63C–E. This air groove allows ambient air access to the skin under pillow 63 and ventilates it accordingly.

As shown in FIG. 11, lower straps 67 are provided. Two segments wrap and tie beneath the woman's breasts, as shown in FIG. 13. String segments 69 of the straps 67 facilitate tying a bow. VELCRO element 66 and mating VELCRO element 66A may be provided on pillow 63 and one or both lower straps 67 for additional security. The lower straps 67 allow for a tighter fit, and the inverted "V" opening 65 provides adjustability for large breasted women.

FIG. 15 shows two breast supports 300A stacked one upon another to support the lower breast and breast support 300B for the upper breast used in conjunction with the head and cervical support 30, and scapula elbow arm rest 80. The preferred form of scapula elbow arm rest 80 is disclosed and dully described in U.S. Pat. No. 5,103,516. The pillow-like supports form a complete system allowing rest, and elevation and support of areas throughout the breast, head, cervical and scapula regions.

Thus, the breast supports of FIGS. 9–15 are especially designed to elevate, support, protect, ventilate, relax, and give comfort to the breast(s) after operation. Air flows freely around the breasts by the air cut-outs 49 and air pocket 53 of breast support 300A. The insulated air allows the bits of polyurethane, used as stuffing, to wriggle around, and provide a mild massage for the breast allowing the blood to circulate freely into the breast with the aid of the scapula elbow arm rests and the head cervical support. The head cervical support is constructed with two flaps at the lower corners. When the flaps are folded backwardly, breast support 300A is placed into the area previously occupied by a flap whereupon a breast is rested, relaxed, ventilated, supported, and protected when the user is lying on her side. The breast on the upper side of the patient is supported, protected, ventilated, and relaxed simultaneously by the use of breast support 300B. Breast support 300B encircles the breast from underneath the breast and keeps it in position. The openings at the comers of the head cervical support supply adequate air flow around the breasts and other regions. The flaps are folded backwardly for better elevation, and blood circulation, and relaxation, which allow for proper sleep, and healing of the breast(s). The scapula elbow arm rests are used simultaneously, also, to elevate, and support the arms allowing air to flow freely around the axillas/armpits. Blood will circulate freely into the breasts and armpits to promote healing of the breast(s).

Breast supports 300A–B have valuable combined effect. Breast support 300B forms a circular protection between both breasts so as to protect the lower breast from pressure caused by the upper breast when the patient is lying on her side. Breast support 300A forms a cushioning protection between the breast and hard surfaces (e.g., the bed). The breast supports are also perfect for nursing mothers with large, tender breasts.

As is apparent from the figures, breast support 300B is constructed with a circular shape. It hugs the breast and keeps it in position, and at the same time, allows air to flow around the breast. A strap is provided to keep breast support 300B in position when strapped around the shoulder. One end of the strap is secured with snaps which allow for adjustment. It is so designed that when the strap is adjusted, the snaps are covered so as to prevent skin irritation.

Figure 17:
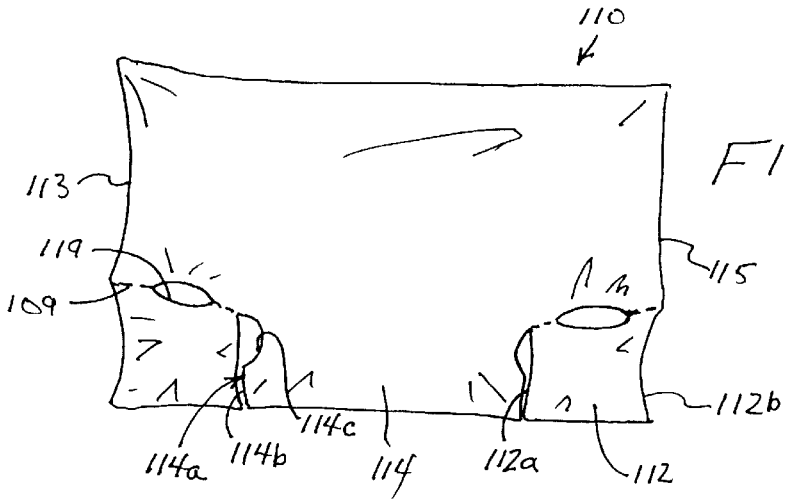
FIG. 17 is a schematic top plan view of a pillow support for the head and cervical region of a user.

As illustrated in FIG. 17, a head cervical pillow or support 110 similar to that shown in FIGS. 1 and 2 has short side edges 113 and 115 which, along with top and bottom edges, are tapered or rounded to connect the top or front surface to the bottom or rear surface. Flaps 112 are defined along their respective inner sides by edge 112*a* and on their outer sides by edge 112*b*. Inner edge 112*a* is slightly concave or straight. A central flap 114 is disposed between flaps 112. The sides of flap 114 are defined by edges 114*a*, which are partially straight at 114*b* and partially concave at 114*c*. An air gap 111 is formed between each flap 112 and flap 114 in the region of the respective concave portion 114*c* of flap edges 114*a*. Air gaps 111 allow ambient air to flow around the head and cervical region, providing ventilation. Also, the front panel of pillow 110 is sewn to the back panel of pillow 110 across the body of the pillow at seams 109. Seams 109 are interrupted by or define apertures 119 enabling air flow between the front and the rear sides of the pillow. Also, by pinching the front and rear panels of pillow 110 together along seams 109 (as described above with reference to FIG. 16B), air grooves or channels similar to air groove 218 are formed along seams 109 and ambient air is allowed to flow there along. Ambient air is allowed to contact the rear neck and shoulders and ventilate same. The pillow 110, flaps 112, and central flap 114 are all stuffed with a suitable material. A recommended stuffing is polyurethane. Pillow 110 is used in different modes as discussed above with respect to pillow 10 and FIG. 2.

The pillow or support of FIG. 17, like the pillow of FIGS. 1 and 2, provides head and cervical support when an individual rests his or her head and neck upon it.

Figure 18:
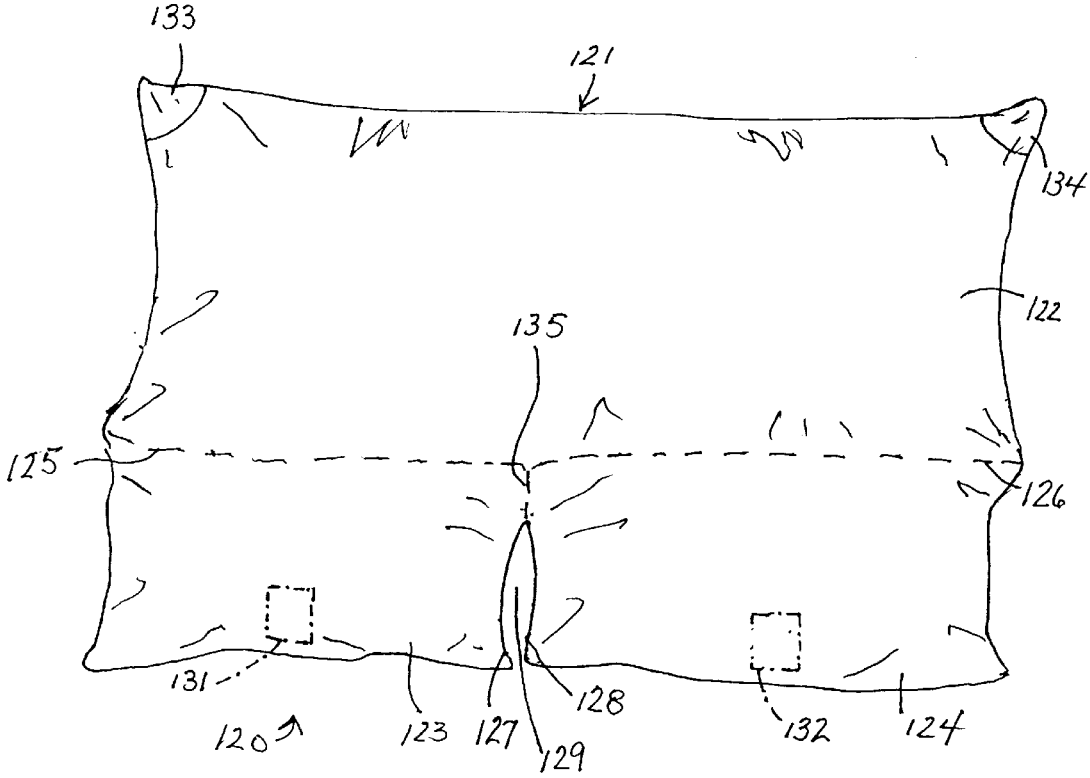
FIG. 18 is a schematic top plan view of a pillow support for the lumbar region of a user.

As depicted in FIG. 18, a lumbar support pillow and support 120 similar to the pillow and support 16 of FIG. 3 includes a main body portion 121 stuffed with polyurethane or other suitable material and defined by front and rear panels 122 (only one shown) sewn to one another along their peripheries. A pair of flaps 123 and 124 at a lower end of the pillow 120 are connected to the main body portion 121 via aligned seams 125 and 126 and to one another via another seam 135. Flaps 123 and 124 are provided with concave inner side edges 127 and 128 which define an air flow channel or passageway 129. Flaps 123 and 124 are optionally provided with VELCRO-type hook or loop connector elements 131 and 132 for facilitating a releasable coupling of lumbar support pillow and support 120 to cushion 22 or protective urinary relief pillow-like support and protector 130. In addition, lumbar support pillow 120 can be used in conjunction with the spine guard of U.S. Pat. No. 5,103,516 (see FIG. 1 of that patent). Hook or loop connector elements 131 and 132 can be used to attach the spinal guard to lumbar support pillow 120.

The lumbar support pillow 120 is made of an appropriate material and stuffing. Recommended materials are Chem Soft for the exterior, and polyurethane for the stuffing. Representative dimensions of the support 140 are 32 inches long (left to right in the drawing) and 23½ inches wide (top to bottom in the drawing). Corners 133 and 134 of main body portion 121 are made of a cloth material which permits the passage of air alternately out of and into pillow 120 upon compression and release thereof. It is to be noted that other pillows and supports disclosed herein may similarly be formed with comers of air permeable material to reduce the stresses that would otherwise be exerted on the peripheral seams holding the various front and back panels together.

Like pillow-like support and protector 6, pillow 120 provides support for the lower back area to just above the buttocks. Air flow channel or passageway 129 allows ambient air to come into contact with the body and thus to ventilate the body areas while the pillow provides elevation and support. A similar air circulation function is performed by air channels formed by seams 126 and 135.

Figure 19:
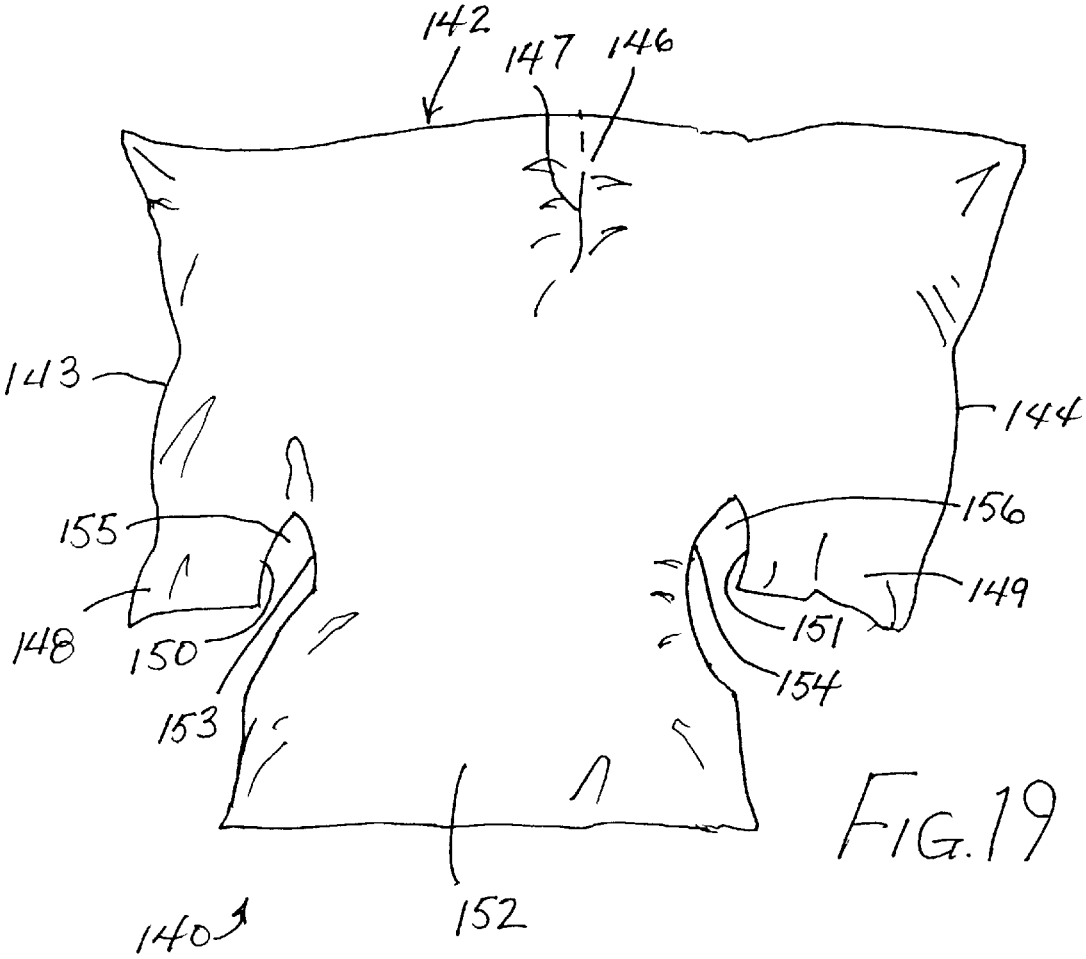
FIG. 19 is a schematic top plan view of a pillow support for the head and shoulder region of a user.

FIG. 19 shows a head and shoulder pillow-like support and protector 140 similar to the pillow 30 of FIG. 5. Both pillows 140 and 30 support, protect, elevate and ventilate the head and shoulder regions of the body. Pillow 140 is generally better when the user is in a prone or lying down, while pillow 30 is especially effective for a user in a sitting or semi-recumbent position. Pillow 140 has an upper region 142, with sides 143 and 144, which elevates, supports, and protects the scapula, upper back, and head and neck region of the user. An air pathway 146 is formed by sewing the front panel of pillow 140 to the rear panel thereof along a seam 147. The upper region 142 of pillow 140 has a pair of downwardly depending flaps 148 and 149 provided with concave inner edges 150 and 151. Flaps 148 and 149 are disposed on opposite sides of an elongated central flap or extension 152 which supports the user's spinal column. Central flap or extension 152 has a pair of concave edges 153 and 154 facing edges 150 and 151 to define therewith a pair of air gaps 155 and 156 for air circulation purposes.

The Chem-Soft material which is recommended for these pillows and supports is long lasting, reusable, self deodorizing, stain restraint, hypoallergentic, noiseless, self sanitizing, flame retardant, bacteria restraint, anti-fungal, and economical. No laundering is necessary with this material as it can be wiped clean with warm soapwater and disinfectant. Although Chem-Soft and poyurethane are the preferred materials for construction of these pillows and supports, other suitable materials, can of course be substituted.

From the above description it will thus be seen that there have been provided pillow-like body support and protection devices usable individually and in various combinations to protect various parts of a person's body from sores and ulcerations, to protect delicate body parts which may otherwise be sore, and to facilitate healing thereof. The pillow-like devices are relatively inexpensive in construction and use and are fabricated from materials that permit ready washing thereof. The various elements are attached to one antoher via conventional methods such as sewing.

It is understood that although I have shown the preferred embodiments of my inventions that various modifications may be made in the details thereof without departing from the spirit of this invention, as comprehended by the following claims.

What is claimed is:

1. A pillow support device comprising:

a pillow member having a pair of opposed panels and resilient stuffing material disposed between said panels, said panels being provided with mutually aligned openings, said panels being connected to one another along said aligned openings to form a central opening or throughhole; and a lip or arrest extending from one of said panels, for holding a bedpan in position below said pillow member so that a cavity of said bedpan communicates with said central opening or throughhole, a cut-through air slot being provided in said pillow member, said cut-through air slot extending from a periphery of said pillow member to said central opening or throughhole for allowing ambient air to circulate in from external to said pillow member and thus ventilate the body area resting upon said pillow member.

2. The device defined in claim 1 wherein a medial seam is provided to form an air groove sewing said panels to one another in a substantially oval or circular path surrounding said central opening or throughhole.

3. The device defined in claim 2 wherein said pillow member is provided with a raised oval shaped area thicker than other areas of said pillow member and substantially surrounding said central opening or throughhole, said oval shaped raised area fitting above the bedpan.

4. The device defined in claim 3 wherein said center opening or throughhole has an hourglass shape.

5. The device defined in claim 3 wherein a skirt is attached to said pillow member about a periphery thereof.

6. The device defined in claim 1 wherein a medial seam is provided to form an air groove sewing said panels to one another in a substantially oval or circular path surrounding said central opening or throughhole.

7. The device defined in claim 1 wherein said pillow member is provided with a raised oval shaped area thicker than other areas of said pillow member and substantially surrounding said central opening or throughhole, said oval shaped raised area fitting above the bedpan.

8. The device defined in claim 1 wherein said center opening or throughhole has an hourglass shape.

9. The device defined in claim 1 wherein a skirt is attached to said pillow member about a periphery thereof.

10. The device defined in claim 1 wherein said pillow member and said lip or arrest form one part of the device, further comprising another part including:

a main body member formed of a pair of panels connected to one another about respective peripheries; and a pair of flaps connected along seams to a side of said main body member, said flaps being formed with opposed concave edges defining therebetween an air gap for air circulation, said seams defining respective channels for air circulation, further comprising releasable connector elements on said main body member releasably coupling said another part to said one part.

11. The pillow defined in claim 10 wherein the panels of said main body member are made of air impermeable material, said main body member being provided with corners made of air peaceable material.

12. A pillow support device comprising:

a pillow member having a pair of opposed panels and resilient stuffing material disposed between said panels, said panels being provided with mutually aligned openings, said panels being connected to one another along said aligned openings to form a central opening or throughhole; and a lip or arrest extending from one of said panels, for holding a bedpan in position below said pillow member so that a cavity of said bedpan communicates with said central opening or throughhole, a seam being provided in said pillow member, sewing said panels to one another to thereby form an air groove.

13. The device defined in claim 12 wherein said pillow member and said lip or arrest form one part of the device, further comprising another part including:

a main body member formed of a pair of panels connected to one another about respective peripheries; and a pair of flaps connected along seams to a side of said main body member;

said flaps being formed with opposed concave edges defining therebetween an air gap for air circulation, said seams defining respective channels for air circulation, further comprising releasable connector elements on said main body member releasably coupling said another part to said one part.

14. The pillow defined in claim 13 wherein the panels of said main body member are made of air impermeable material, said main body member being provided with corners made of air permeable material.

15. The pillow support device defined in claim 12 wherein said seam is a medial seam extending along a substantially oval or circular path surrounding said central opening or throughhole.

16. The device defined in claim 12 wherein said pillow member is provided with a raised oval shaped area thicker than other areas of said pillow member and substantially surrounding said central opening or throughhole, said oval shaped raised area fitting above the bedpan.

17. The device defined in claim 12 wherein said center opening or throughhole has an hourglass shape.

18. The device defined in claim 12 wherein a skirt is attached to said pillow member about a periphery thereof.

19. A pillow support device comprising:

a pillow member having, a pair of opposed panels and resilient stuffing material disposed between said panels, said panels being provided with mutually aligned openings, said panels being connected to one another along said aligned openings to form a central opening or throughhole;

a lip or arrest extending from one of said panels, for holding a bedpan in position below said pillow member so that a cavity of said bedpan communicates with said central opening or throughhole; and a skirt is attached to said pillow member about a periphery thereof.

20. The device defined in claim 19 wherein said pillow member and said lip or arrest form one part of the device, further comprising another part including:

a main body member formed of a pair of panels connected to one another about respective peripheries; and a pair of flaps connected along seams to a side of said main body member, said flaps being formed with opposed concave edges defining therebetween all air gap for air circulation, said scams defining respective channels for air circulation, further comprising releasable connector elements on said main body member releasably coupling said another part to said one part.

* * * * *